US005174783A

United States Patent [19]

Stassen et al.

[11] Patent Number: 5,174,783

[45] Date of Patent: Dec. 29, 1992

[54] CABLE CONNECTING MODULE

[75] Inventors: Joe Stassen, Plaisir, France; Terrence J. Amyes, Swindon, England

[73] Assignee: Raychem Limited, London, England

[21] Appl. No.: 571,609

[22] PCT Filed: Feb. 23, 1989

[86] PCT No.: PCT/GB89/00187

§ 371 Date: Oct. 3, 1990

§ 102(e) Date: Oct. 3, 1990

[87] PCT Pub. No.: WO89/08337

PCT Pub. Date: Sep. 8, 1989

[30] Foreign Application Priority Data

Feb. 23, 1988 [GB] United Kingdom ..... 8804134

[51] Int. Cl.[5] ..... H01R 4/24

[52] U.S. Cl. ..... 439/410; 439/425

[58] Field of Search ..... 439/395, 397, 404–407, 439/409–419, 425, 427, 394, 492–499

[56] References Cited

U.S. PATENT DOCUMENTS

| | | | |
|---|---|---|---|
| 2,673,968 | 3/1954 | Smith | 439/417 |
| 3,041,575 | 6/1962 | Schneider | 339/99 |
| 3,573,713 | 4/1971 | Enright et al. | 339/98 |
| 3,766,514 | 10/1973 | Kimm | 339/99 |
| 3,768,067 | 10/1973 | Rault | 339/99 |
| 3,816,819 | 6/1974 | Judd | 339/99 |
| 3,976,351 | 8/1976 | Hopfe | 339/99 |
| 3,980,380 | 9/1976 | Cieniawa et al. | 339/99 |
| 4,062,614 | 12/1977 | Gressitt et al. | 339/97 |
| 4,240,687 | 12/1980 | Bunnell et al. | 339/99 |
| 4,415,215 | 11/1983 | Goozner | 339/98 |
| 4,492,815 | 1/1985 | Maros | 174/78 |
| 4,543,716 | 10/1985 | Damiano et al. | 29/871 |
| 4,726,785 | 2/1988 | Kerboul et al. | 439/417 |
| 4,921,439 | 5/1990 | Bofill et al. | 439/417 |

FOREIGN PATENT DOCUMENTS

| | | | |
|---|---|---|---|
| 0083738 | 7/1983 | European Pat. Off. | 439/418 |
| 0209452 | 7/1986 | European Pat. Off. . | |
| 196925 | 8/1986 | European Pat. Off. . | |
| 2351514 | 5/1976 | France . | |
| 833222 | 4/1960 | United Kingdom . | |
| 973394 | 10/1964 | United Kingdom . | |
| 995417 | 6/1965 | United Kingdom . | |
| 1078907 | 8/1967 | United Kingdom . | |
| 1099208 | 1/1968 | United Kingdom . | |
| 1462920 | 1/1977 | United Kingdom . | |

*Primary Examiner*—David L. Pirlot

*Attorney, Agent, or Firm*—Marguerite E. Gerstner; Timothy H. P. Richardson; Herbert G. Burkard

[57] ABSTRACT

A cable connection module comprises a first part that receives a multi-conductor flat cable and that has two pairs of spring loaded insulation piercing teeth. The first part of the module has a channel through which the cable passes and into which the teeth are urged when the first part of the module is screwed into engagement with a second part of the module. The second part of the module has an enclosure formed from metal contact elements that surround the insulation-piercing teeth and provide cam surfaces for urging the teeth through the cable insulation and into engagement with the conductors.

5 Claims, 5 Drawing Sheets

CABLE CONNECTING MODULE

This invention relates to an electrical connecting module, and is applicable for connecting to a single or multi-core cable, of rotational symmetric or asymmetric configuration. The cable may be of circular cross-section, but the connection module is particularly, though not exclusively, suitable for use with a generally flat cable, for example of substantially rectangular configuration.

The connector of the invention obviates the requirement of stripping insulation from the or each conductor.

In accordance with one aspect of the present invention, a connecting arrangement comprises an insulating housing that has a tapered inner surface and a pair of co-operating insulation-piercing teeth, the teeth and tapered surface being movable relative to each other so as to engage an insulated conductor when placed therebetween, pierce its insulation and thus allow electrical connection to be made thereto.

For a multi-conductor cable, a corresponding number of pairs of insulation-piercing teeth may be provided—for example in side-by-side relationship when the cable is a flat cable.

In accordance with a further aspect of the present invention, there is provided an arrangement for making electrical connection on to an insulated conductor, the arrangement comprising an insulating housing and a pair of insulation-piercing conductive teeth that are arranged to receive the conductor therebetween and, on relative movement between the pair of teeth and the housing, longitudinally of the conductor, to pierce the conductor insulation and make contact with the conductor.

The invention finds particular application for connecting to a self-regulating heater cable having a positive temperature coefficient (PTC) of resistance. Such cables may have two (or more) elongate conductors (bus bars) that are embedded in a conductive polymeric material that has a positive temperature coefficient (PTC) of resistance, and that is itself enclosed within an insulating polymeric sheath and perhaps also a metallic earthing braid and outer protective polymeric jacket. Such PTC heating cables are disclosed in for example U.S. Pat. Nos. 4,334,148, 4,318,881, 4,334,351, 4,400,614, 4,398,084, 4,582,983, 4,659,913, 4,574,188, 4,459,473, 4,638,150. Heaters for which the connector of the present invention is particularly suitable are sold by Raychem's Chemelex Division, for example under the trade names AUTOTRACE, HWAT, and WINTERGARD. In some operating conditions, connection to such cables can be a time-consuming operation, and skill can be required to remove reliably the conductive and insulating polymeric materials in order to expose the conductors. The present invention on the other hand, allows quicker and less craft sensitive connections to be made.

Advantageously, the insulating housing comprises a metal enclosure that is arranged to surround the spring-loaded insulation-piercing teeth. In this way, when the portion of the housing that carries the cable and teeth is urged into the enclosure, sufficient force can be applied to the teeth to force them through the cable insulation and make good electrical contact with the conductors. The metal enclosure may be in several parts that are electrically insulated from each other for co-operation with respective pairs of teeth and thus respective conductors.

The housing portion mounting the teeth may be slid into the portion having the metal enclosure and this action can be arranged by means of a threaded engagement between the two parts of the housing.

In some insulation-piercing cornection arrangements, there is a tendency for the conductors of a multi-conductor cable to be urged towards each other, by compression of the insulation therebetween for example. With the self-regulating heater cables referred to above, this can have an adverse effect on their operation because of the electrical characteristics of the material in which the bus bars are embedded. Accordingly, it can be advantageous to introduce an insulating member between the conductors when making connection to such a cable, or otherwise to ensure that the cable is not damaged.

Several embodiments of connecting arrangements, each in accordance with the present invention, will now be described, by way of example, with reference to the accompanying drawings, in which.

Figure 1:
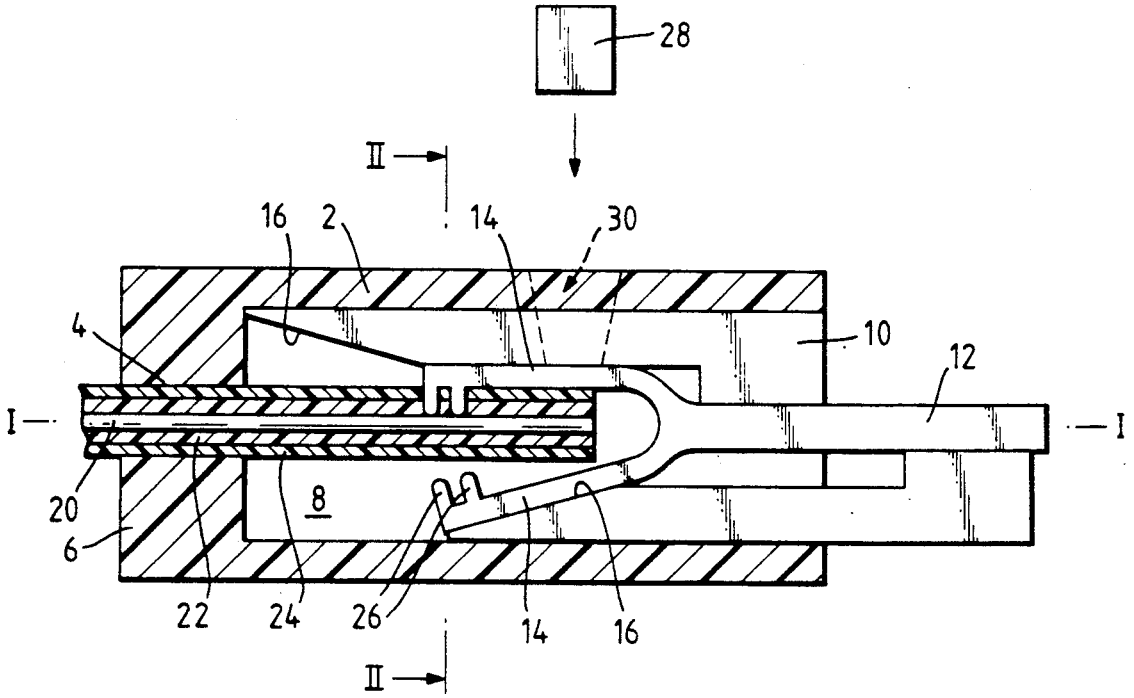
FIG. 1 is a side elevation of one embodiment of the arrangement showing an open configuration below the line I—I and a closed configuration above the line I—I.
Figure 2:
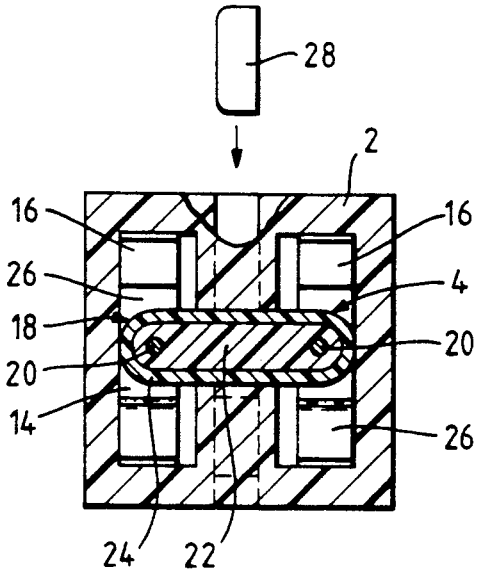
FIG. 2 is a sectional elevation along the line II—II showing the connecting module in its open configuration.

Referring to FIGS. 1 and 2, the connection arrangement has an insulating polymeric housing 2 with a rectangular aperture 4 in an otherwise-closed front wall 6. The aperture 4 opens into a chamber 8 within which is slidably mounted an insulating polymeric cam arrangement 10 and a pair of resilient metal contact members 12 (only one of which is visible in FIG. 1) that are insulated from each other.

As shown in FIG. 1 below the line I—I, the cam arrangement 10 is withdrawn from the housing 2, and the resilient arms 14 of the contact members 12 lie along respective tapered surfaces 16 of the cam arrangement 10 so that each contact member 12, and thus the connecting arrangement as a whole, is in its open configuration.

In the open configuration, a generally flat PTC heating cable 18 is inserted as a tight fit through the housing aperture 4, and between the open arms 14 into abutment with the contact member 12. The cable 18 has two elongate conductors 20 embedded in partially conductive polymeric material 22 enclosed within a polymeric insulating jacket 24.

The free end of each of the arms 14 of the contact member 12 is provided with a pair of inwardly-directed teeth 26. Operation of the connector involves moving the cam arrangement 10 longitudinally inwardly from the position shown below the line I—I to the position shown above the line I—I. This causes the resilient arms 14 to be driven by a sliding movement along the cam surface 16 such that the teeth 26 of each contact member 12 pierce the cable insulation 24 and the conductive medium 22 and contact respective ones of the cable conductors 20 from opposite sides thereof. Connections from the pins of the contact members 12 that extend beyond the housing 2 may be made to a further cable in any convenient manner. The cam arrangement is advantageously operated in response to the screwing together of two parts of a housing in which it is mounted, as described for example with reference to FIG. 5 and 6 hereof.

To maintain the electrical separation of the conductors 20 in the region of connection to the cable 18 an insulating peg 28 is driven through the cable 18 in the region of the partially conductive material 22 between the conductors 20 and between the contact members 12.

Figure 3:
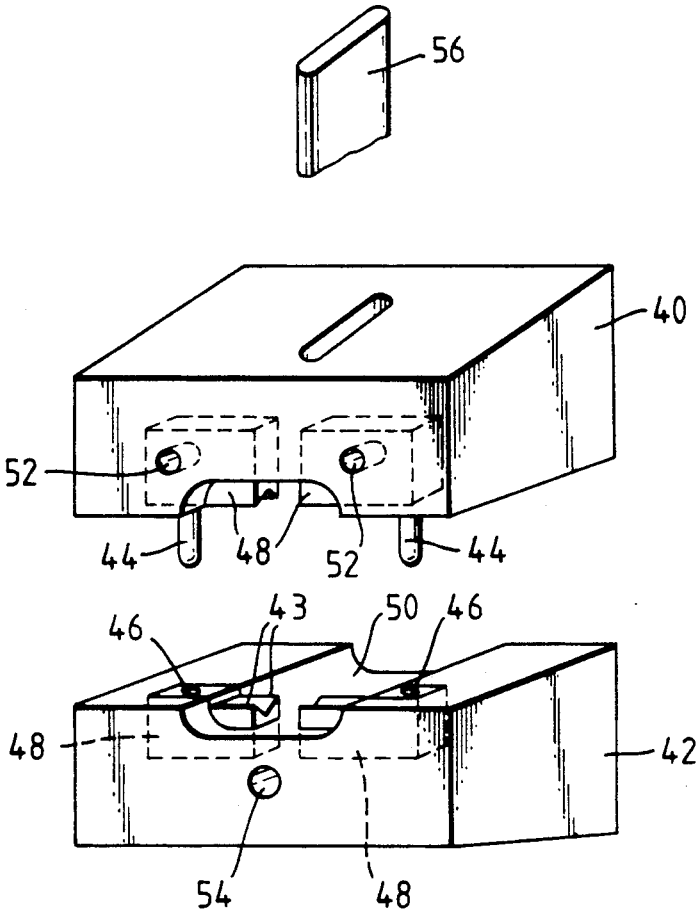
FIG. 3 show the internal components only of a second embodiment of the invention.

FIG. 3 shows another embodiment of connecting arrangement, in which two tapered blocks 40, 42 clamp together inside a tapered housing (not shown) around a cable similar to the cable 18 described above. The block 40 has a pair of locating pegs 44 its lower face that engage with mating holes 46 in the upper face of the block 42. Four metal connecting members 48, two in each of the opposing faces of the blocks 40, 42, each have two blades 43 for piercing the insulation of the heater cables secured in a channel 50 that extends through the blocks. At least one of each pair of opposing connecting members 48 may be springloaded to enhance the electrical connection. Two of the connecting members have holes 52 extending to the front face of the upper block 40, and are arranged to receive pins to provide electrical contact via the connecting members 48 to the conductors of the cables. A third hole 54 in the lower block 42 can be arranged to receive a further connecting pin for ensuring earth continuity through the connector. As shown, provision is also included for an insulating peg 56 to be driven between the cable conductors in a similar manner to that described above.

Advantageously, further locating pegs and mating holes may be provided at the rear of the blocks 40,42 to maintain the orientation therebetween.

Figure 4A:
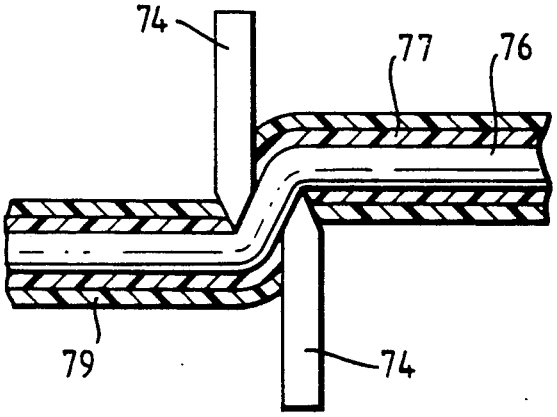
FIG. 4A shows schematically a part of the connecting arrangement.
Figure 4:
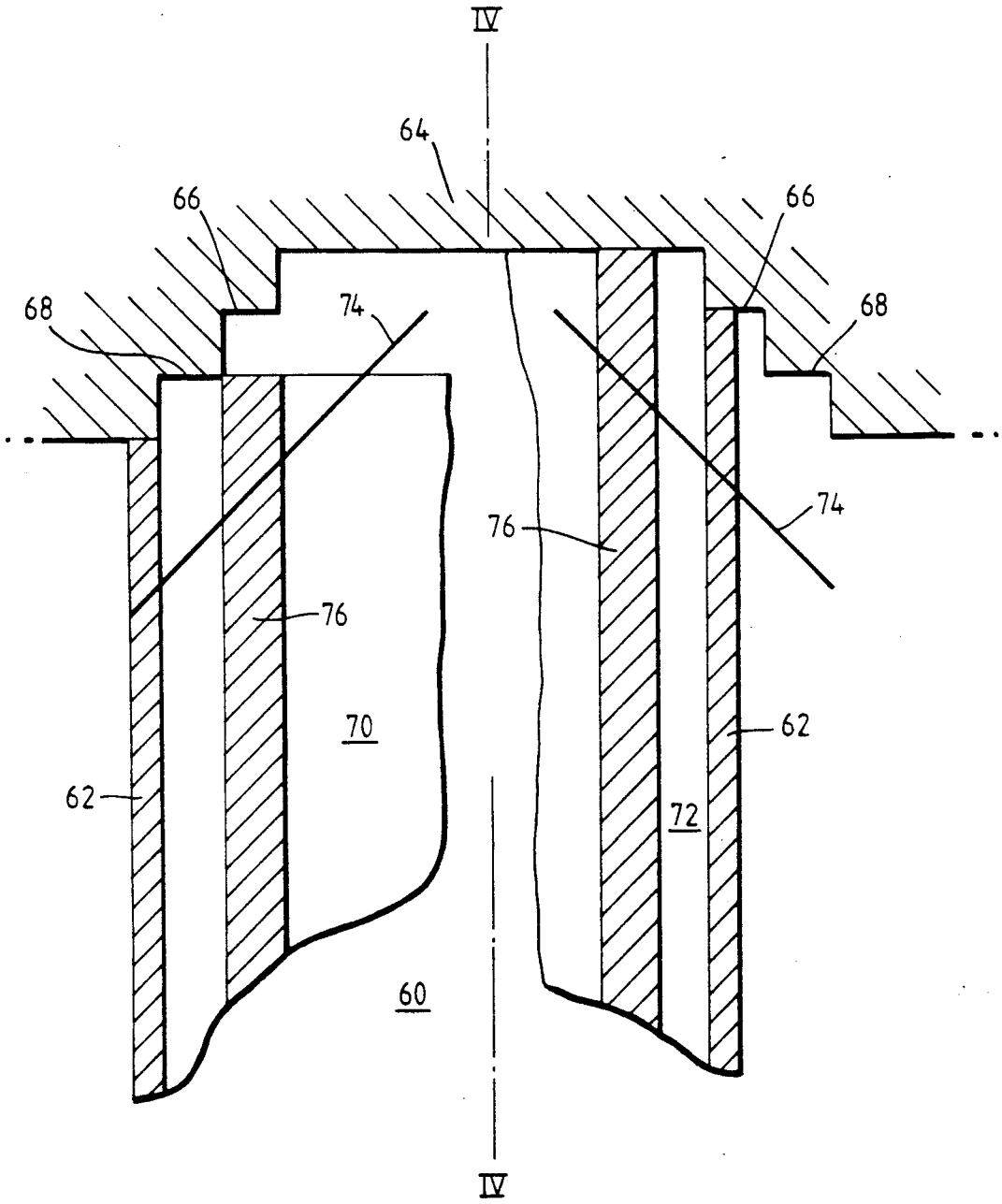
FIG. 4 shows diagrammatically an alternative connecting arrangement.

It is envisaged that an alternative arrangement of cable insulation piercing blades may be employed, and also an arrangement for limiting the inward movement of the heater cable into its receiving channel, and these are shown in FIG. 4 diagrammatically in plan view.

Referring to FIG. 4, the channel 60 is defined by side walls 62 and an end wall 64 that has two steps 66 and 68. The side walls 62 are adjustable transversely so as to provide the channel 60 with its maximum width when positioned at the outer edges of the steps 68 (as shown to the left of the line IV—IV), with an intermediate width when they are moved inwardly to the inner edges of the steps 68, and with a minimum width when they are moved inwardly to the inner edges of the steps 66 (as shown to the right of the line IV—IV). Thus, for a rectangular heater cable of (large) width, say 11 mm, the side walls are set to the maximum width and the cable 70 is pushed into the channel 60 as far as it will go, that is to say into abutment with the steps 68 of the end wall 64, as seen in the left hand side of FIG. 4. On the other hand, for a heater cable of (narrow) width, say 7 mm, the side walls are set to the minimum width and the cable 72 extends all the way into the channel 60, as seen in the right hand side of FIG. 4.

The two cable-cutting blades 74 of the connector are fixed transversely with respect to the channel 60, and are set at an acute angle to the axis of the cable. As can be seen by comparison of the two sides of FIG. 4, in each case the blades 74 would contact the conductors 76 of the cables 70,72 at the same distance from the end of the cables.

The cutting edges used in the connectors of the present invention may have one, two or more blades, and they may be vertically aligned one above the other, or alternatively they may be offset and thus provide a scissor action, with the insulation being removed therebetween.

The scissor action is exemplified in FIG. 4A, which shows a pair of opposed cutting edges 74 that are offset from one another longitudinally of the cable such that the conductor 76 is trapped therebetween and electrical contact is made, whilst the surrounding polymeric conductive material 77 and protective polymeric insulating material 79 is forced away from the contact area.

A connector embodying the principle of cooperating connecting blocks having cutting edges being urged together so as to penetrate and make connection with an electric cable when two parts of a connector housing are screwed together, will now be described in more detail with reference to FIGS. 5 and 6.

The connector 80 comprises two insulating cylindrical outer housing portions 82, 84, each of which is threadedly engageable with an inner mounting block 86. A three-core power supply cable (not shown) enters the housing 82 through a cable gland 88 and has its live and neutral conductors connected to respective ones of the terminals 90,92 that lie spaced apart alongside each other, the terminal 92 being longer than the terminal 90. The earth conductor of the power cable is connected to an earth terminal 94.

A twin core rectangular self regulating heater cable having an outer earthing braid (not shown) enters the housing 84 through a cable gland 96 and, with the housing portions 82,84 disassembled, passes into an elongate rectangular guiding channel 98 in a monolithic rectangular connecting block 100. In practice, the heater cable, unstripped apart from the cutting back of its earthing braid, is allowed to extend slightly beyond the end 102 of the block 100 so as to ensure it is completely encompassed by the connecting means. A first pair of opposing connecting members 104 is mounted towards the end 102 of the block 100, and an identical second pair 106 is mounted away from the end 102 along the stem 108 of the block 100 at a position laterally offset such that the pairs of connecting members may be aligned with respective ones of the terminals 90,92 as hereinafter described. The lateral and longitudinal offsets of the connecting members 104, 106 serve to reduce the insertion force and also maintain electrical separation cf the conductive components. Each of the connecting members 104, 106 is in the form of a short cylinder that may be spring-loaded so as to be biased to extend radially beyond the block stem 108 as shown in FIG. 6. Each of the members 104, 106 has a double cutting edge at its inner end, as shown in FIG. 5. With the connecting members 104,106 in their withdrawn, or open position, (FIG. 6) the heater cable can pass freely along the channel 98 that extends therebetween. On closure of the connector 80, by screwing the housing portion 84, containing the heater cable located in the connecting block 100, on to the mounting block 86, the stem 108 of the block 100 is urged into a passageway 110. At its outer end the passageway has an inwardly directed taper defined by the surfaces 112, and this leads into an inner portion of uniform cross-section of shape and size substantially equal to that of the connecting block stem 108. Thus as the two parts of the connector 80 are screwed together, the connecting members 104, 106 successively ride along the tapering surfaces 112 and are urged down into the stem 108. This causes the cutting edges of the connecting members to penetrate the insulation and conductive polymeric material of the heater cable and to make electrical connection with respective ones of the bus bar conductors of the cable. By the time the connecting members 104, 106 reach the uniform inner portion of the passageway 110, electrical and mechanical connection to the heater cable is complete. Further inward movement of the connecting block 100 then causes engagement between the terminals 90,92 with apertures in the upper ones of the connecting members 104, 106 respectively. At the same time, the earthing terminal 94 passes through a third aperture in the connecting block stem 108 to make electrical contact with the braid of the heater cable, being clamped by a spring-loaded ring 120.

Figure 5:
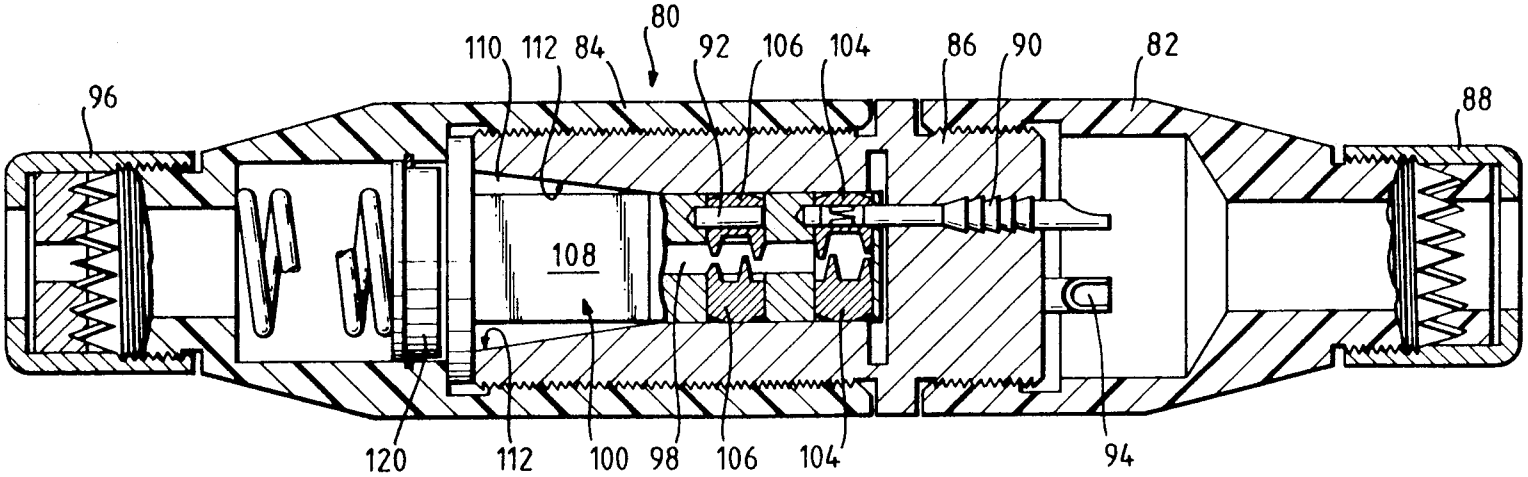
FIG. 5 shows in partial sectional elevation a further embodiment of connecting module.
Figure 6:
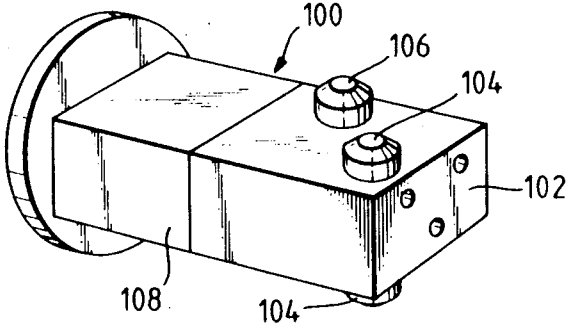
FIG. 6 shows a component of the connecting module of FIG. 5 in elevation.
Figure 7:
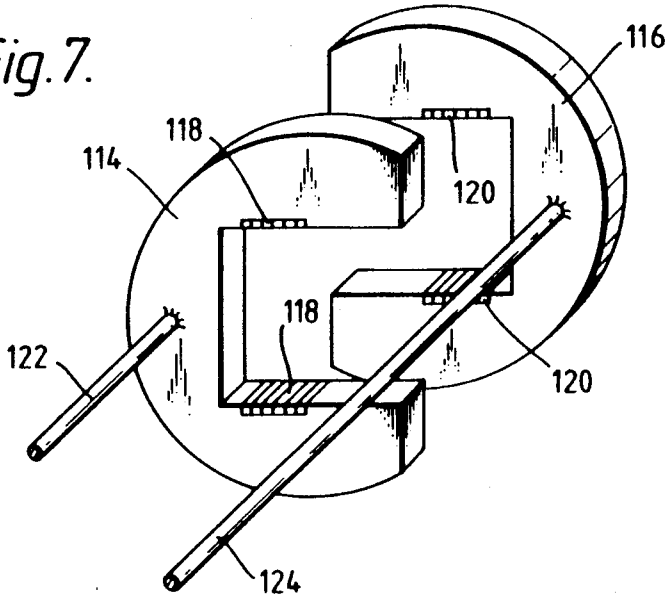
FIG. 7 shows a modification of one component of the connector of FIG. 5.

FIG. 7 shows a modification of the mounting block 86 of FIG. 5, and the manner in which electrical contact is made between the pins 104,106 of the connecting block 100 and the terminals 90,92. A pair of generally C-shaped metal contact pieces 114,116 are moulded into the polymeric insulating body 86 to extend around the uniform square crosssectional portion of the passageway 110. They are positioned such that when the connecting block 100 is fully inserted into the passageway 110, and thus extends through the contact pieces 114,116, a pair of flat multi-lam contacts 118 of the contact piece 114 make electrical contact with respective ones of the pins 104, and a pair of flat lam contacts 120 of the contact piece 116 make electrical contact with respective ones of the pins 106. Thus, should any softening or flow of the polymeric body 86 occur in operation, the rigidity that is provided by the metal inserts 114,116 around the pins 104,106 still ensures continuity of the electrical connections. Respective conductors 122,124 extend away from the contact pieces 114,116 to provide electrical connection to the terminals 90,92.

Figure 8:
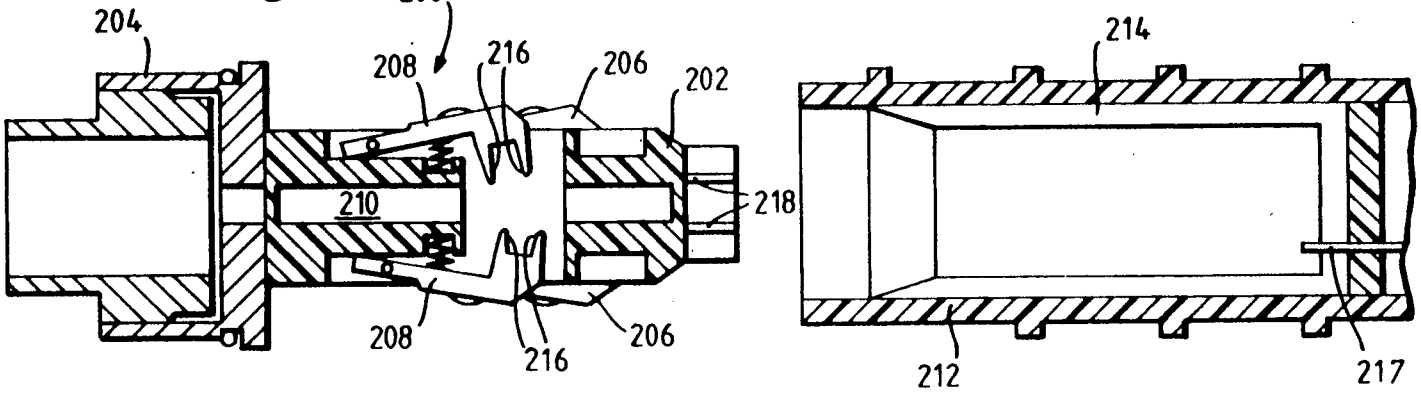
FIG. 8 shows a further preferred modification of the connector of FIG. 5.

FIG. 8 shows in partial sectional elevation an exploded view of an alternative and preferred connecting form of connecting block and associated contact arrangement that may be arranged within a modified mounting block 86 for use in the connector of FIG. 5.

Referring to FIG. 8, the connecting block 200 has a generally rectangular insulating forward portion 202 and a conducting rear portion 204 of generally circular crosssection. Two pairs of metal contact members 206, 208 are mounted in the forward portion 202 and are spring loaded outwards so as to leave an elongate rectangular guide channel 210, that is closed at its front end, free for the entry of an insulated heater cable (not shown)from the rear portion 204. The contact members are located in pairs that are transversely and longitudinally offset from each other for contacting, in operation, respective ones of the two conductive bus bars of the heater cable.

The connecting block portion 202 is arranged to be inserted into a generally cylindrical mounting block 212 that is of insulating material and that carries two removable and interchangeable metal inserts 214 electrically insulated from each other, for cooperating with respective pairs of the contact members 206, 208 on each side of the connecting block 200. The two inserts 214 form a generally rectangular enclosure within the block 212, for receiving the connecting block 200. The inserts 214 are tapered at their leading edges so that on insertion of the connecting block 200 into the mounting block 212, the contact members 206, 208 are urged down into the channel 210. This action urges the piercing teeth 216 of the contact members through the insulation of the heater cable and through the partially conductive material in which the elongate conductors are embedded so as to clamp from opposite sides on to the cable conductors themsleves. In this way, two electrical paths are formed from the conductors through respective contact members 206 and 208 to respective ones of the inserts 214. Two multi-lam pin contacts 217 are moulded into the mounting block 212 so as to pass through and make electrical contact with respective ones of the inserts 214, so as to extend the conductive paths back through the block 212 and hence to respective cores of a supply cable (not shown) in the manner as described with respect to FIG. 5. Earth continuity through the connector is provided from the rear metal portion 204 of the connecting block 200, within which the earthing braid of the heater cable is changed, via a pair of pins 218 that extend therefrom to the front of the block. The pins 218 engage with sockets (not shown) at the inner end of the mounting block 212 adjacent the pin contacts 217 that are connected to the earth conductor of the power supply cable. This arrangement is symmetrical at least to the extent that the connecting block 200 may be rotated about its axis by 180°, and the inserts 214 are interchangeable and slidably mounted within the mounting block 212.

The spring loading of the various connecting members ensures a constant pressure on the terminals, thus ensuring high integity of the electrical connections under all operating conditions, including thermal cycling. It will be appreciated that a high current-carrying capacity is required of a self-regulating heater, since typically, operating at 220/240 volts, a continuous current level of about 20 amps can be experienced, whilst a peak current of about 120 amps can flow instantaneously on start up of a heater at −30° C. because of its low resistance at that temperature.

Although the connectors described herein have only two cores, it will be appreciated that they may easily be modified for use with cables having one or three or more conductive cores.

The electrical connection may be made safely, quickly and easily, without the need for any great skill, and without requiring the insulation to be stripped from the cable Where appropriate, any feature from any embodiment herein described may be used in combination with any other feature of another embodiment.

We claim:

1. An arrangement for making electrical connection to insulated conductors of a multi-conductor cable, the arrangement comprising (a) an insulating housing cmoprising two parts, and (b) a plurality of pairs of insulation-piercing teeth associated with respective conductors of the cable and mounted within said housing so as to receive a respective conductor therebetween;

wherein (i) said insulative housing contains a metal enclosure having portions insulated from each other and associated with respective pairs of said insulation-piercing teeth, and (ii) each metal enclosure portion (1) defines cam surfaces that, on relative movement between said two parts of the insulating housing, are arranged to urge the associated pair of teeth through the insulation of, and into electrical contact with, the received conductor and (2) electrically interconnects respective insulation-piercing teeth with electrical contacts of the arrangement thereby to allow electrical connection to the insulated conductors of the cable.

2. An arrangement according to claim 1, wherein said two parts of said insulating housing are arranged to be screwed together thereby to effect said connection to the cable conductor.

3. An arrangement according to claim 1, wherein a first of said parts of said insulating housing contains said cam surfaces, and a second of said parts of said insulating housing carries said insulation piercing teeth and is arranged to receive, guide and firmly retain the cable therein.

4. An arrangement according to claim 1, arranged to receive a generally flat multi-conductor cable with conductors thereof extending substantially parallel with each other, the arrangement comprising insulating means arranged to be disposed between the conductors of the cable.

5. The combination of an arrangement according to claim 4 and a flat multi-conductor heating cable.

* * * * *